US011580836B2

(12) United States Patent
Gadonniex et al.

(10) Patent No.: US 11,580,836 B2
(45) Date of Patent: Feb. 14, 2023

(54) SMOKE DETECTOR WITH INTEGRATED SENSING

(71) Applicant: Carrier Corporation, Palm Beach Gardens, FL (US)

(72) Inventors: Dennis M. Gadonniex, Bradenton, FL (US); Rick Wolf, Sarasota, FL (US)

(73) Assignee: Carrier Corporation, Palm Beach Gardens, FL (US)

( * ) Notice: Subject to any disclaimer, the term of this patent is extended or adjusted under 35 U.S.C. 154(b) by 0 days.

(21) Appl. No.: 17/443,199

(22) Filed: Jul. 22, 2021

(65) Prior Publication Data

US 2022/0036710 A1 Feb. 3, 2022

Related U.S. Application Data

(60) Provisional application No. 62/706,070, filed on Jul. 30, 2020.

(51) Int. Cl.
*G08B 17/107* (2006.01)
*G08B 29/14* (2006.01)

(52) U.S. Cl.
CPC ..... *G08B 17/107* (2013.01); *G08B 29/145* (2013.01)

(58) Field of Classification Search
CPC ..... G08B 29/145; G08B 17/00; G08B 17/10; G08B 17/103; G08B 17/107; G08B 17/113; H05B 45/50; G01N 15/06; G01N 2015/0693
See application file for complete search history.

(56) References Cited

U.S. PATENT DOCUMENTS 3,809,913 A * 5/1974 Prellwitz ..... G01N 21/534 340/630
7,015,820 B2 3/2006 Bobenhausen
10,302,522 B2 5/2019 Williamson
(Continued)

FOREIGN PATENT DOCUMENTS

AU 2012201531 A1 4/2012
FR 3054916 A1 2/2018
KR 102077519 B1 2/2020

OTHER PUBLICATIONS

EP Application No. 21187783.2, Extended Search Report, dated Jan. 4, 2022, 7 pages.
(Continued)

*Primary Examiner* — Curtis J King
(74) *Attorney, Agent, or Firm* — Souad Hakim

(57) ABSTRACT

A smoke detector and method for testing a smoke detector are provided. The smoke detector includes a housing defining a chamber, an emitter, and a receiver. The housing includes an inlet port and an outlet port configured to allow an airflow to pass through the chamber. The emitter is configured to emit light into the chamber. The receiver is configured to receive light reflected by ambient materials in the airflow passing through the chamber. The smoke detector includes an entry point and an exit point, defining a channel therebetween. At least a portion of the airflow passes through the channel. The channel is in fluid communication with a sensor. The sensor is configured to detect at least one of a pressure differential and a mass flow of the airflow. The smoke detector and method for testing the smoke detector enable in situ testing of the smoke detector.

18 Claims, 13 Drawing Sheets

(56) References Cited

U.S. PATENT DOCUMENTS

| | | | | |
|---|---|---|---|---|
| 2004/0246137 | A1* | 12/2004 | Bobenhausen | G08B 29/043 340/606 |
| 2005/0083205 | A1* | 4/2005 | Deacy | G08B 19/005 340/506 |
| 2010/0328082 | A1* | 12/2010 | Danz | G08B 17/10 340/584 |
| 2011/0094294 | A1* | 4/2011 | Townsend | G08B 29/145 73/37 |
| 2011/0314902 | A1* | 12/2011 | Dantler | G01N 1/14 73/28.01 |
| 2013/0160571 | A1 | 6/2013 | Williamson | |
| 2016/0035216 | A1* | 2/2016 | Townsend | G08B 29/145 340/515 |
| 2019/0023426 | A1* | 1/2019 | Gray | B01D 53/62 |

OTHER PUBLICATIONS

IN Application No. 202114033542, Examination Report, dated Feb. 23, 2022, 7 pages.

* cited by examiner

SMOKE DETECTOR WITH INTEGRATED SENSING

CROSS REFERENCE TO A RELATED APPLICATION

The application claims the benefit of U.S. Provisional Application No. 62/706,070 filed Jul. 30, 2020, the contents of which are hereby incorporated in their entirety.

BACKGROUND

A detector is a device that capable of detecting a property of an environment (e.g., temperature and/or humidity of a room, etc.) and/or the presence of a hazard in the environment (e.g., smoke and/or carbon monoxide (CO) in a room, etc.). A smoke detector is a type of detector that is capable of, at a minimum, detecting the presence of smoke (e.g., a smoke detector may be able to detect the presence of CO in addition to detecting smoke, etc.). A photo-electric smoke detector is a type of smoke detector that detects smoke using light reflection principles.

Conventional photo-electric smoke detectors include an optic chamber configured to receive smoke particles, at least one light emitter configured to emit light into the chamber, and at least one light receiver configured to receive light reflected off of the smoke particles in the chamber. When there is no smoke in the optic chamber, and the optic chamber is empty or mostly empty, the light receiver typically receives a small amount of light reflected from the chamber surfaces. On the other hand, when smoke is present in the optic chamber, the light receiver receives more light due to the light being reflected from the smoke particles. When an amount of light received by the receiver exceeds a certain threshold, an alarm is triggered.

Smoke detectors can be used to detect the presence of smoke in a number of different environments (e.g., both in commercial and residential buildings). For example, smoke detectors may be designed so that they can detect smoke from within a heating, ventilation, and air conditioning (HVAC) system (e.g., within a commercial building). To detect smoke within an HVAC system, smoke detectors are commonly installed within HVAC ducts. To ensure that the smoke detectors within the ducts are operating correctly, the National Fire Protection Association (NFPA) recommends that regular testing be conducted. For example, regular testing of the differential pressure between the inlet and outlet ports of the smoke detector is recommended. Typically to obtain the differential pressure reading external pressure sensors are used. However, use of external pressure sensors for testing is highly inconvenient, as the installation and later removal of the external pressure sensors is a time-consuming manual process. For example, each smoke detector being tested must be manually partially uninstalled (to place the external pressure sensor) and then later manually reinstalled (to put the smoke detector back in an operational state) by a service technician.

Depending on the size of the commercial building there may be multiple smoke detectors placed throughout the ductwork of the HVAC system. As can be assumed, it can be very onerous to complete the testing of all of the smoke detectors within the HVAC system. Additionally, with the traditional testing methods requiring a service technician, the smoke detectors may not be tested outside of the required testing periods, as the owners/tenants of the commercial building may not want to spend resources doing tests of the smoke detectors beyond what is required.

Accordingly, there remains a need for a smoke detector, and method of testing such smoke detector, that is capable of detecting smoke within an HVAC duct and has an increased ability to be regularly tested (e.g., compared to existing smoke detectors that are capable of detecting smoke within an HVAC duct).

BRIEF DESCRIPTION

According to one embodiment a smoke detector is provided. The smoke detector includes a housing, an emitter, a receiver, an entry point, and an exit point. The housing defines a chamber. The housing includes an inlet port and an outlet port configured to allow an airflow to pass through the chamber. The emitter is configured to emit light into the chamber. The receiver is configured to receive light reflected by ambient materials in the airflow passing through the chamber. The entry point and the exit point define a channel therebetween, at least a portion of the airflow passing through the channel. The channel is in fluid communication with a sensor. The sensor is configured to detect at least one of a pressure differential and a mass flow of the airflow.

In accordance with additional or alternative embodiments, the entry point is disposed in the inlet port.

In accordance with additional or alternative embodiments, the exit point is disposed in the outlet port.

In accordance with additional or alternative embodiments, at least one of the entry point and the exit point have a manifold configuration.

In accordance with additional or alternative embodiments, the smoke detector further includes a controller in communication with the sensor, the controller configured to trigger a notification when the sensor detects at least one of: a mass flow outside of an acceptable mass flow range, a negative pressure differential, and a negative mass flow.

In accordance with additional or alternative embodiments, the acceptable mass flow range is between 100 CFM and 4000 CFM.

In accordance with additional or alternative embodiments, the smoke detector further includes a supporting structure, at least one of the emitter, the receiver, the sensor, and the controller disposed on the supporting structure.

In accordance with additional or alternative embodiments, the supporting structure is a printed circuit board (PCB).

In accordance with additional or alternative embodiments, the smoke detector further includes an optics cover disposed between the housing and the supporting structure.

In accordance with additional or alternative embodiments, the optics cover includes a recessed area the recessed area configured to receive a channel cover, the channel defined between the recessed area and the channel cover.

In accordance with additional or alternative embodiments, the smoke detector further includes at least one O-ring disposed between the optics cover and the sensor.

In accordance with additional or alternative embodiments, at least one of the inlet port and the outlet port are configured to receive a tube.

In accordance with additional or alternative embodiments, the smoke detector is configured to detect ambient materials within an HVAC duct.

In accordance with additional or alternative embodiments, the housing includes at least one attachment point for securing the smoke detector to the HVAC duct.

In accordance with additional or alternative embodiments, the smoke detector detects ambient materials within the HVAC duct using at least one of: a multi-wave multi-angle detection method, a backscatter detection method, and a forward scatter detection method.

According to another aspect of the disclosure, a method for testing a smoke detector is provided. The smoke detector includes a controller in communication with a sensor. The smoke detector includes a housing defining a chamber. The housing includes an inlet port and an outlet port configured to allow an airflow to pass through the chamber. The smoke detector further includes an entry point and an exit point, defining a channel therebetween. At least a portion of the airflow passes through the channel. The channel is in fluid communication with the sensor. The method is performed in the controller. The method includes a step for receiving, from the sensor at the controller, output signals indicating at least one of a pressure differential and a mass flow of the airflow. The method also includes a step for determining, in the controller, whether the output signals indicate a need to trigger a notification.

In accordance with additional or alternative embodiments, the method further includes a step for triggering a notification when the output signals indicate at least one of: a mass flow outside of an acceptable mass flow range, a negative pressure differential, and a negative mass flow.

In accordance with additional or alternative embodiments, the acceptable mass flow range is between 100 CFM and 4000 CFM.

BRIEF DESCRIPTION OF THE DRAWINGS

The subject matter, which is regarded as the disclosure, is particularly pointed out and distinctly claimed in the claims at the conclusion of the specification. The following descriptions of the drawings should not be considered limiting in any way. With reference to the accompanying drawings, like elements are numbered alike:

DETAILED DESCRIPTION

Figure 1:
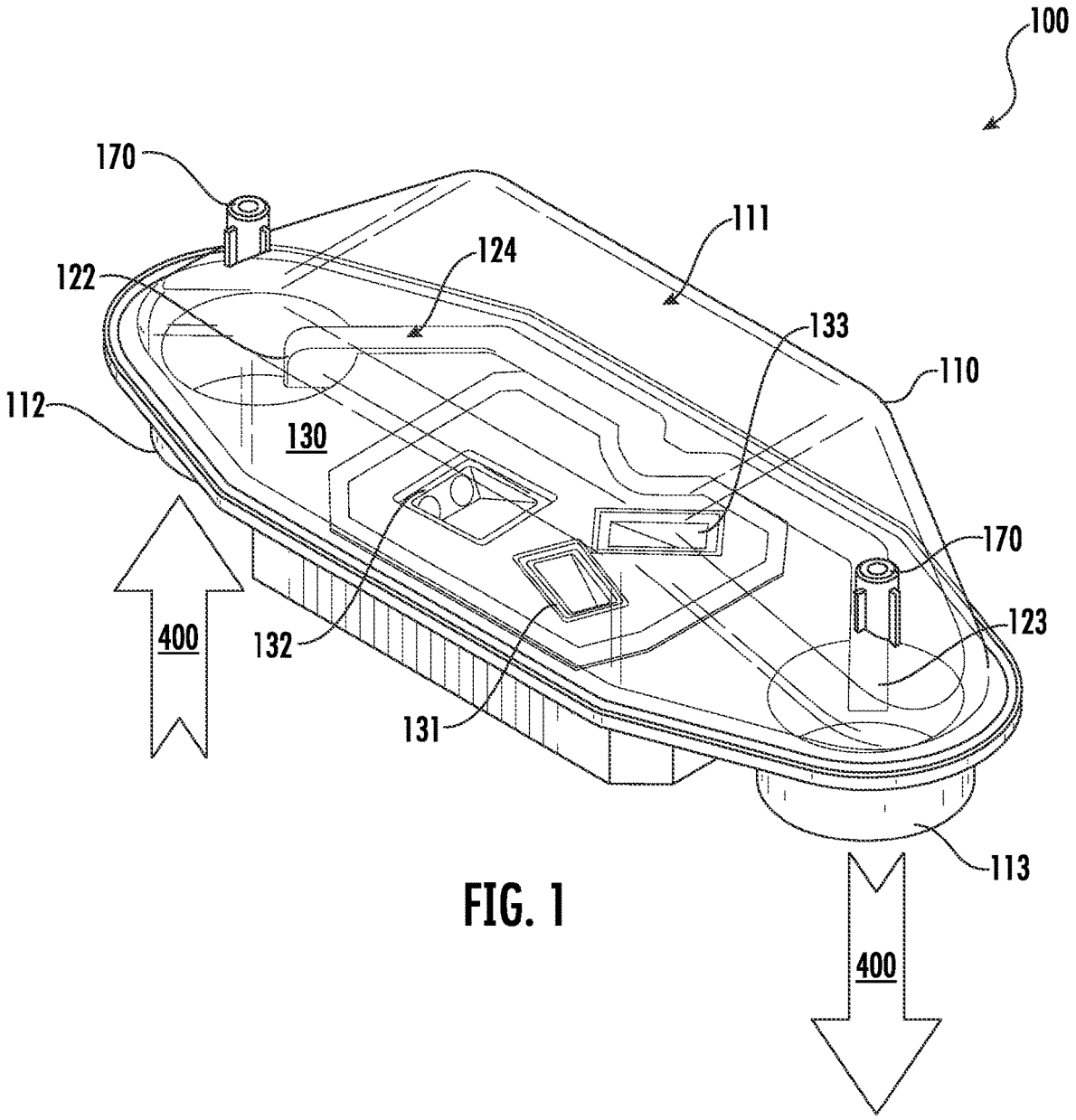
FIG. 1 is a perspective view of a first embodiment of the smoke detector with an inlet port and an outlet port in accordance with one aspect of the disclosure.

Different agencies around the world set standards for the functional testing of smoke detectors configured within HVAC ducts. For example, Underwriter Laboratories (UL) recommends (through standard 268-A) that smoke detectors configured within HVAC ducts be functionally tested once a year. This functional testing commonly includes ensuring that the velocity of the airflow is within the proper range (e.g., between 100 and 4000 CFM for UL 268-A). It should be appreciated that each standard (e.g., set by each independent agency) may have different requirements (e.g., different velocity ranges, etc.) and/or recommended testing periods. Making sure the velocity of the airflow is within the proper range is critical to ensure that the smoke detector can accurately detect the presence of smoke. It should be appreciated that each smoke detector may be designed (e.g., by technology providers) and certified (e.g., by a certification agency such as UL) to detect smoke in an airflow with a certain range (e.g., between 100 and 4000 CFM) of velocity and, as such, it is critical that the velocity of the airflow be within the required range. The design and configuration of the smoke detector described herein has an increased ability to be regularly tested (e.g., compared to existing smoke detectors that are capable of detecting smoke within an HVAC duct), which may help ensure that the velocity of the airflow is within the proper range. It is envisioned that by making functional testing easier to complete, the functional testing may be able to be completed more routinely (e.g., more than the once a year, recommended by UL).

It should be appreciated that the smoke detector described herein may include one or more emitter(s) and one or more receiver(s) to allow the smoke detector to detect smoke. It is envisioned that the smoke detector may use at least one of: a multi-wave, multi-angle detection method, a backscatter detection method, and a forward scatter detection method. For example, the smoke detector (when utilizing a multi-wave, multi-angle detection method) may include multiple emitters configured to emit multiple kinds of light at various angles to one or more receivers, which may generate a combination of infrared forward scatter, infrared back scatter, and blue forward scatter. However, to reduce the cost and complexity of the smoke detector, the smoke detector (when utilizing a backscatter detection method) may include only one emitter and only one receiver configured to generate a backscatter effect (e.g., the emitter may be configured to emit light into a chamber where it is reflected at an angular distance less than 90° by ambient materials in the chamber toward a receiver).

Regardless of the method of detection utilized by the smoke detector, in various instances, the emitter(s) and the receiver(s) may be mounted to the upper surface of a supporting structure (e.g., a printed circuit board (PCB) or other substrate) using surface-mount technology. It should be appreciated that although the components may be mounted using surface-mount technology, in various instances, the components may be mounted through punctured holes in the supporting structure. A supporting structure may be viewed as a component of a smoke detector that mechanically supports and communicatively connects components (e.g., the emitter, receiver, and/or controller) of the smoke detector (e.g., using conductive tracks, pads, or other features etched from one or more layers of copper onto and/or between one or more non-conductive sheets).

Surface-mount technology is a method of mounting electrical components directly onto a surface (e.g., an upper surface) of a supporting structure (e.g., a printed circuit board (PCB) or other substrate). This method may provide for a solder pad (e.g., made of tin-lead, or gold plated copper) to be placed at each respective location where a component is to be mounted on the supporting structure. Additionally, the method may provide for solder paste (e.g., made of flux and solder particles) to be applied to each respective solder pad (e.g., using screen printing process, or jet-printing mechanism) before the components are mounted on the respective solder pads. It should be appreciated that alternative methods of surface mounting the components (e.g., the emitter(s) and the receiver(s)) may be utilized. For example, the components (e.g., the emitter(s) and the receiver(s)) may be mounted to the supporting structure using a plug-in connection that may or may not require solder pads and/or solder paste. To place each of the components the method may incorporate a pick-and-place machine, which may remove the need for manual placement of the components.

The ability to use the pick-and-place machine may be enabled by the design of the smoke detector. For example, the smoke detector may be designed to operate in a vertical fashion where the components (e.g., the emitter(s) and the receiver(s)) are placed and operate in a vertical fashion (instead of relying on precise horizontal angles), which may make the pick-and-place machine a viable option to use in the manufacturing process. It should be appreciated that although the components may be placed and designed to operate in a vertical fashion, in various instances, the components may be placed and designed to operate in a horizontal fashion. Regardless of how placed, once the components are placed on the supporting structure the supporting structure may be placed in a heating device (e.g., a soldering oven) to bond the components to the supporting structure. To remove excess material (e.g., flux and solder) each supporting structure may be washed before the supporting structure is configured within the smoke detector. Although the smoke detector described herein may be manufactured using a pick-and-place machine, it should be appreciated that the smoke detector may be manufactured using any suitable manufacturing method (e.g., 3D printing, etc.).

It is envisioned that regardless of the specific method of detection or manufacturing process used, the smoke detector described herein is able of being more easily functionally tested (e.g., when compared conventional duct smoke detectors) in situ without being removed or partially removed from a duct or other installed position. The smoke detector described herein incorporates a sensor capable of completing functional testing of the smoke detector, which removes the need for the installation of an external pressure sensor to complete functional testing.

With reference now to the Figures, a smoke detector 100 in accordance with various aspects of the disclosure is shown in FIG. 1. The smoke detector 100 may be referred to as a "detector" in certain instances. Although described herein to be used to detect smoke, the detector 100 may be used to detect other constituents capable of entering the detector 100 (e.g., carbon monoxide, pollutants, other hazardous or nuisance materials) in certain instances. The smoke detector 100 is capable of detecting when ambient materials such as air and smoke and non-smoke particles carried by an airflow 400 enter the chamber 111 (described below). The smoke detector 100 is a photo-electric smoke detector in certain instances.

As shown in FIGS. 1, 2, 5, 7 and 8, the smoke detector 100 includes a housing 110 defining a chamber 111, the housing 110 including an inlet port 112 and an outlet port 113 configured to allow an airflow 400 to pass through the chamber 111. It should be appreciated that the chamber 111 may be viewed as the internal space within the housing 110 (e.g., bounded inside the housing 110, above the optics cover 130). The smoke detector 100 includes an emitter 131 configured to emit light into the chamber 111. As mentioned above the smoke detector 100 may include multiple emitters (e.g., a first emitter 131 and a second emitter 132, and as many others as may be required (not shown)), each of which may be configured to emit light into the chamber 111. The emitter(s) 131, 132 may be any suitable technology (e.g., a light emitting diode (LED)) capable of emitting light (e.g., non-visible light such as infrared, or any light in the visible spectrum such as blue light). The smoke detector 100 includes a receiver 133 (e.g., which may be a photodiode) configured to receive light reflected by ambient materials in the airflow 400 passing through the chamber 111. The smoke detector 100 also includes an entry point 122 and an exit point 123, defining a channel 124 therebetween, at least a portion of the airflow 400 passing through the channel 124. The channel 124 is in fluid communication with a sensor 150 (exemplarily shown in FIGS. 8, 9, and 10). Being in fluid communication may be interpreted to mean that substantially all of the airflow 400 that passes through the channel 124 also passes through a sensor 150. It is envisioned, although not shown, that there may be multiple sensors (e.g., with the channel 124 branching (not shown) toward the various sensors (not shown)) in certain instances. It should be appreciated that substantially all of the airflow 400 that passes through the channel 124 passes through at least one sensor 150. The sensor 150 is configured to detect at least one of a pressure differential and a mass flow of the airflow 400 (e.g., by reading the airflow 400 that passes through the sensor 150). It should be appreciated that the sensor 150 may be a pressure sensor (e.g., capable of taking a differential pressure reading) in some instances, and a mass flow detector (e.g., capable of taking a mass flow reading) in some instances.

Figure 2:
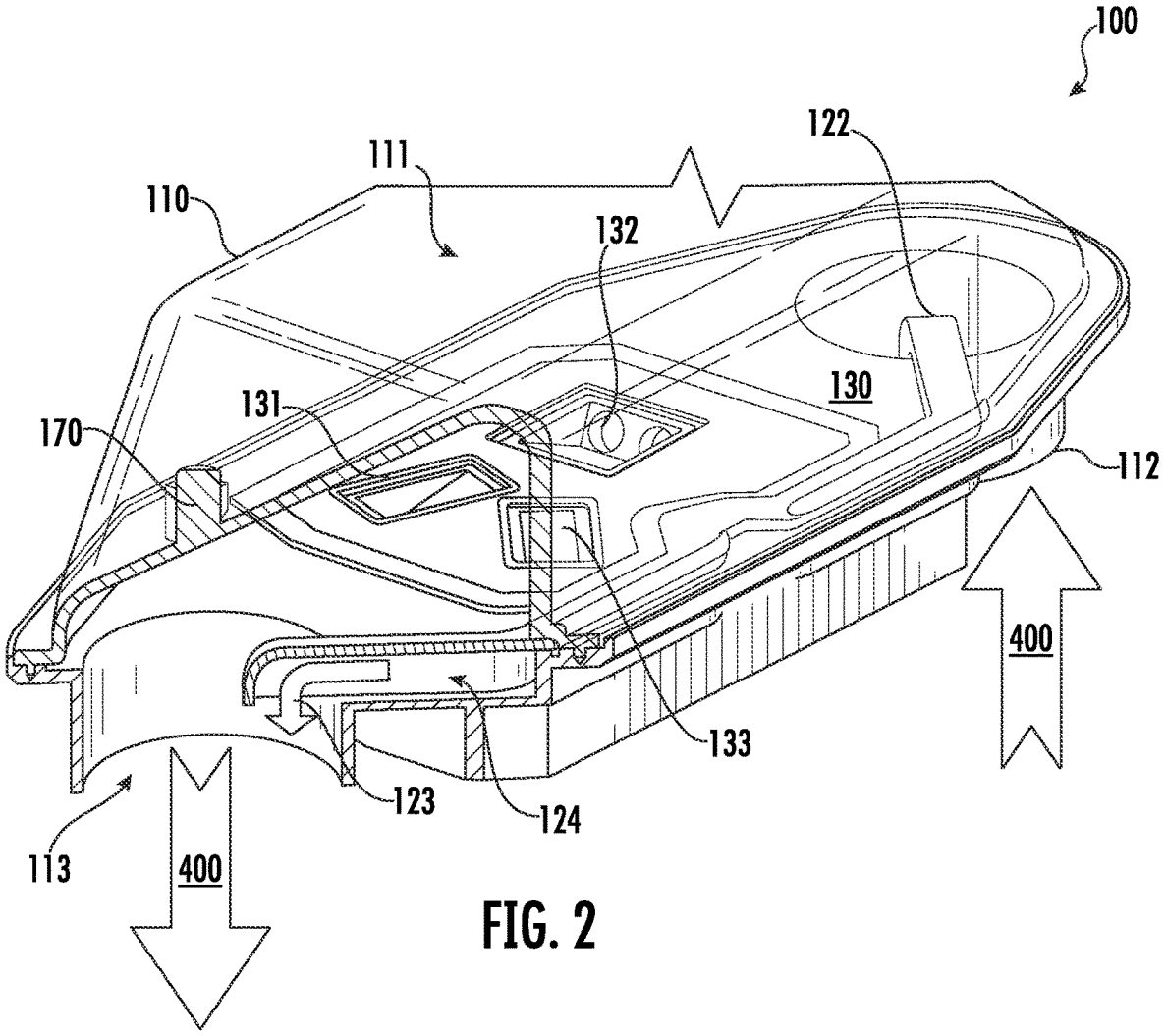
FIG. 2 is cross-sectional view of the outlet port of the smoke detector shown in FIG. 1 in accordance with one aspect of the disclosure.

Regardless of the specific type of sensor 150 used, the sensor 150 is configured to receive at least a portion of the airflow 400 that passes through the smoke detector 100 (e.g., substantially all of the airflow 400 that is passed through the channel 124). It should be appreciated that the channel 124 may viewed as a hollow body (e.g., tubing, formed plastic, etc.) that connects the entry point 122 with the exit point 123. As shown in FIGS. 1 and 2 (which depict the exemplary first embodiment of the smoke detector 100) and FIGS. 7 and 8 (which depict the exemplary third embodiment of the smoke detector 100), the entry point 122 may be disposed in the inlet port 112. As shown in FIGS. 1 and 2 (depicting the exemplary first embodiment of the smoke detector 100) the exit point 123 may be disposed in the exit port 113. Being disposed in a port 112, 113 may be interpreted to mean that at least a portion of the point 122, 123 may be configured to block part of the cross-sectional area of the port 112, 113 (e.g., to ensure at least a portion of the airflow 400 passes through the channel 124).

Figure 5:
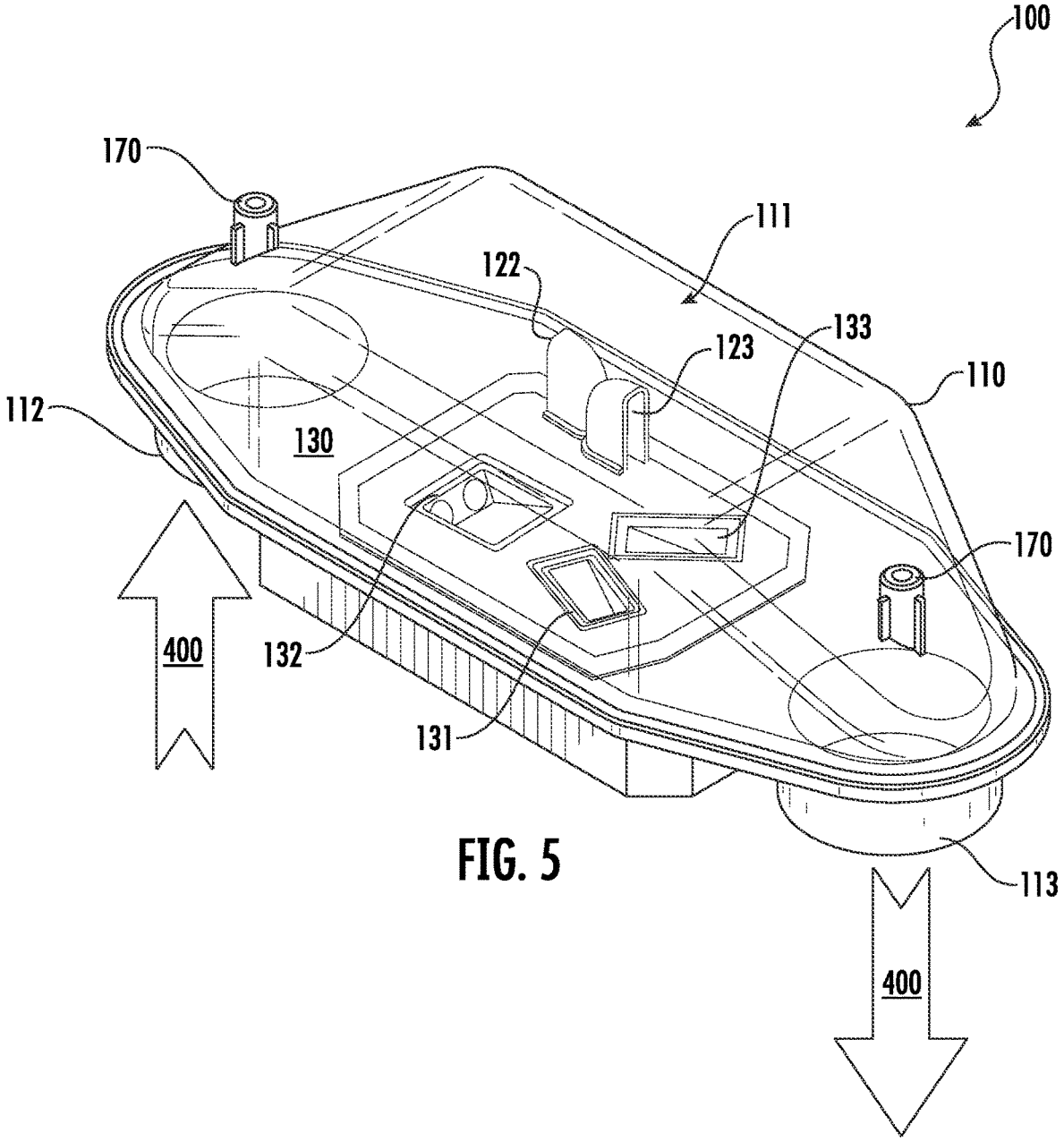
FIG. 5 is a perspective view of a second embodiment of the smoke detector with an inlet port and an outlet port in accordance with one aspect of the disclosure.
Figure 6:
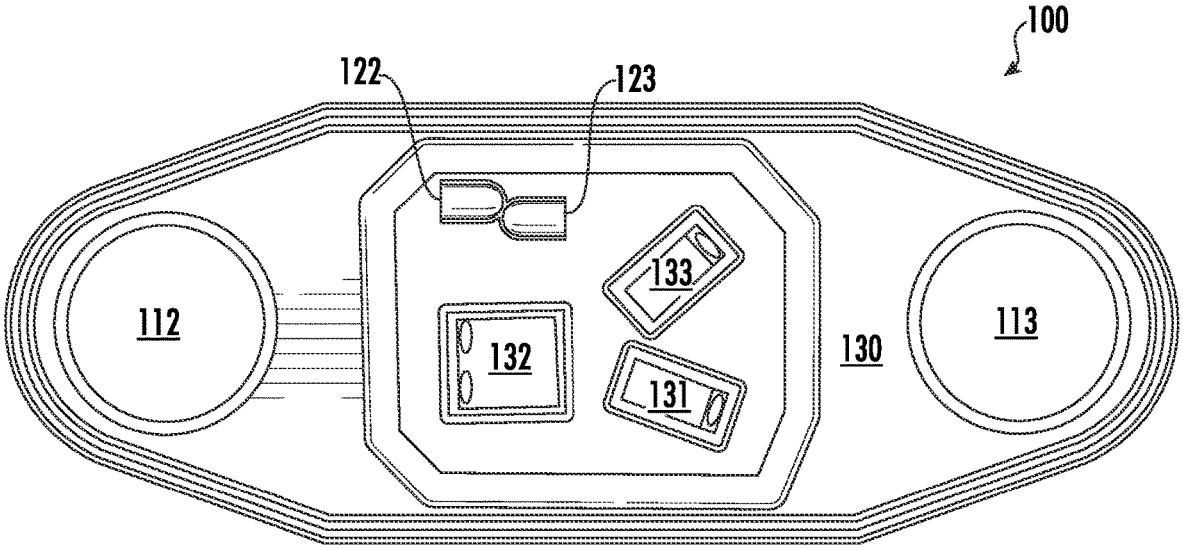
FIG. 6 is a perspective top view of the smoke detector shown in FIG. 5 in accordance with one aspect of the disclosure.
Figure 7:
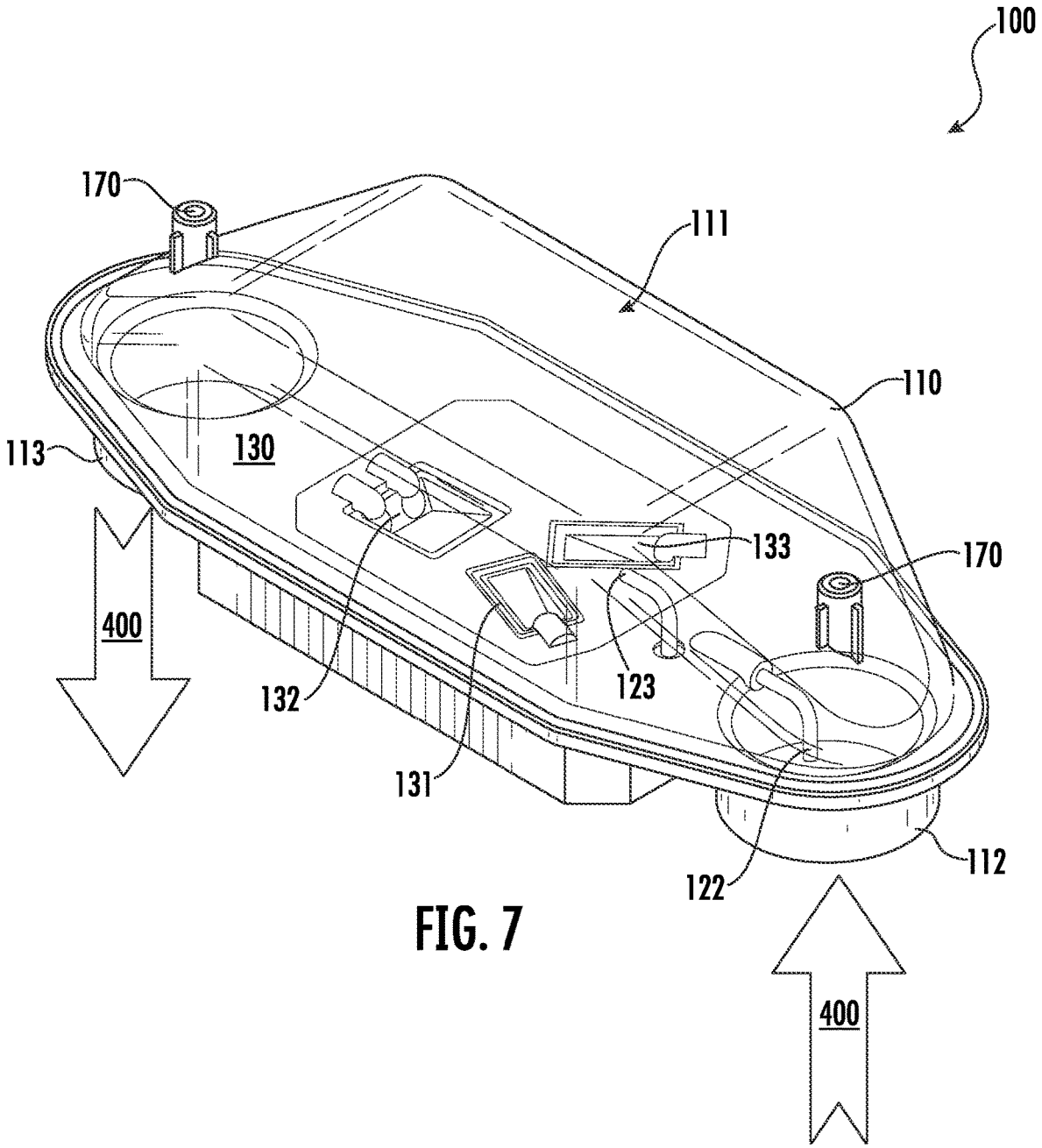
FIG. 7 is a perspective view of a third embodiment of the smoke detector with an inlet port and an outlet port in accordance with one aspect of the disclosure.
Figure 8:
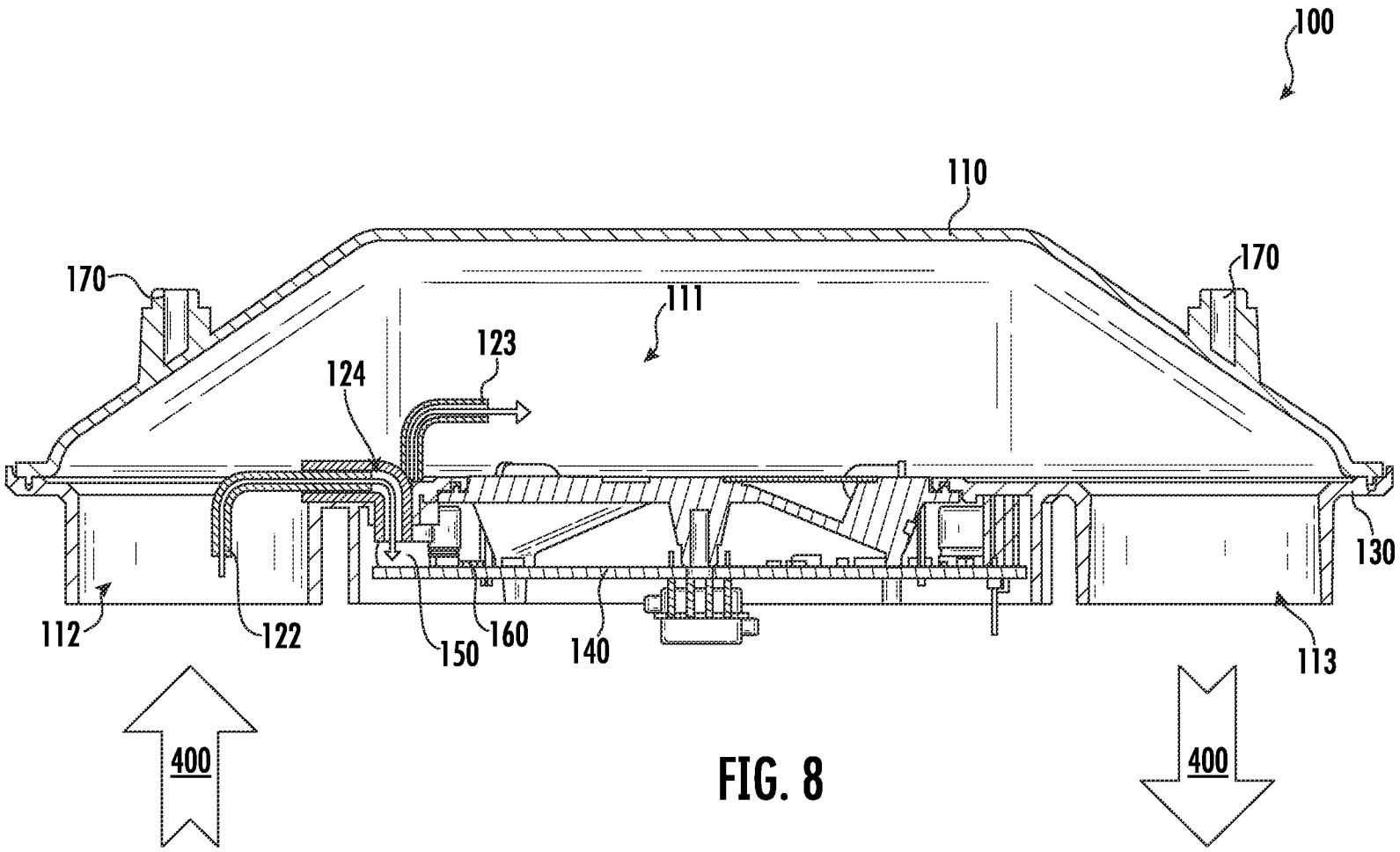
FIG. 8 is cross-sectional side view of the smoke detector shown in FIG. 7 in accordance with one aspect of the disclosure.
Figure 9:
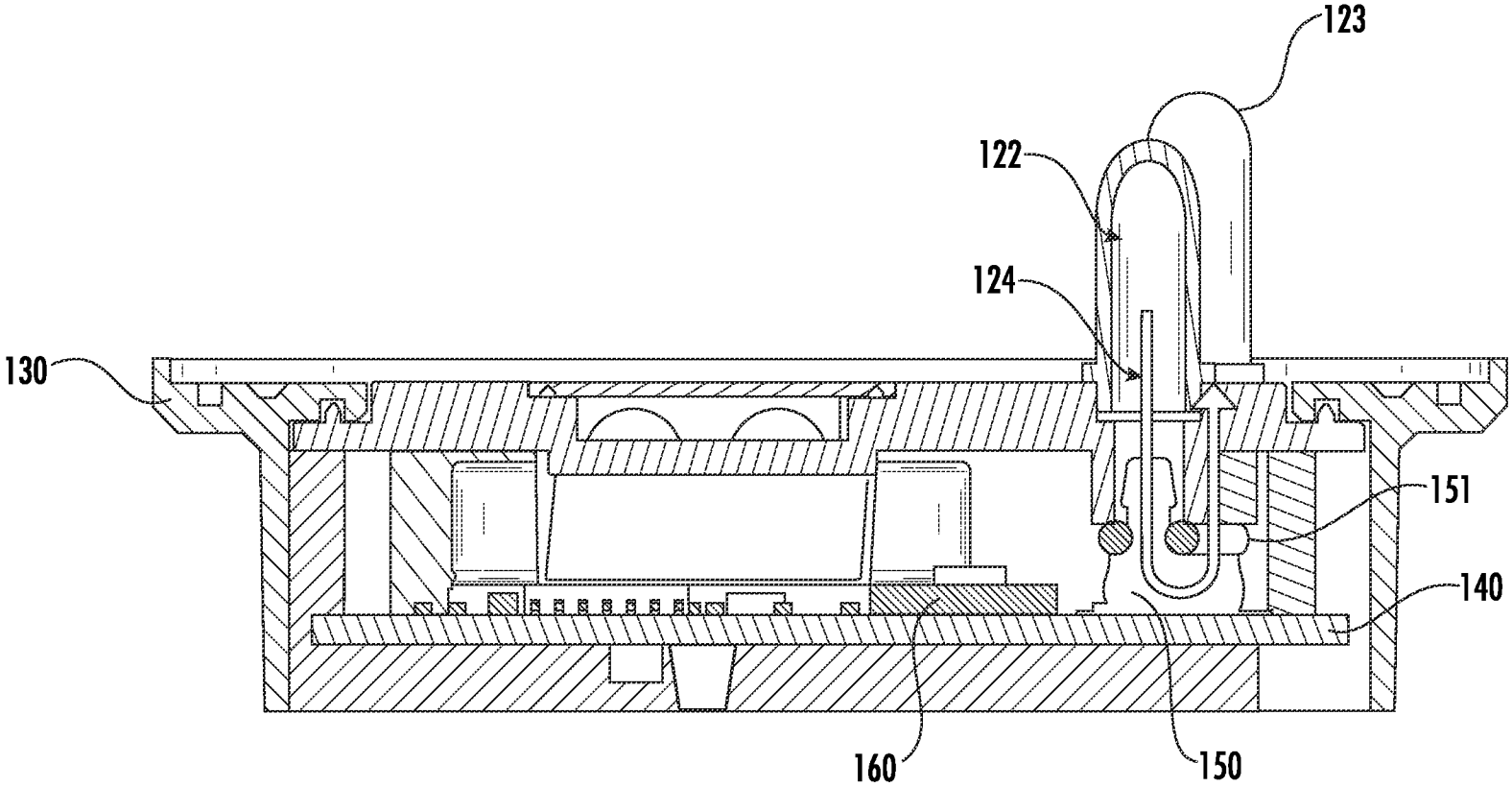
FIG. 9 is a cross-sectional view of a sensor disposed on a supporting structure of the smoke detector shown in FIG. 5 in accordance with one aspect of the disclosure.

At least one of the entry point 122 and the exit point 123 may have a manifold configuration (as shown in FIGS. 5, 6, and 9, which depict the exemplary second embodiment of the smoke detector 100, and as shown in FIGS. 7 and 8, which depict the exemplary third embodiment of the smoke detector 100). A manifold configuration may be viewed as a hood-like structure with an opening on one side (e.g., directed toward a port 112, 113). It is envisioned that the opening of the the manifold configuration for the entry point 122 may be directed toward the inlet port 112, and the opening of the manifold configuration for the exit point 123 may be directed toward the outlet port 113.

It should be appreciated that regardless of whether the point 122, 123 is disposed in a port 112, 133 or has a manifold configuration, the size (e.g., cross-sectional area covered) of the point 122, 123 may be chosen based on the amount of airflow 400 needed for sampling (e.g., by the sensor 150). For example, the entry point 122 may have a larger cross-sectional area when larger volumes of airflow 400 are needed for sampling (e.g., to detect the pressure differential and/or mass flow of the airflow 400). The required amount of airflow 400 needed for sampling may be based upon the specification (e.g., provided by the manufacturer of the sensor 150) for the particular sensor 150.

Figure 10:
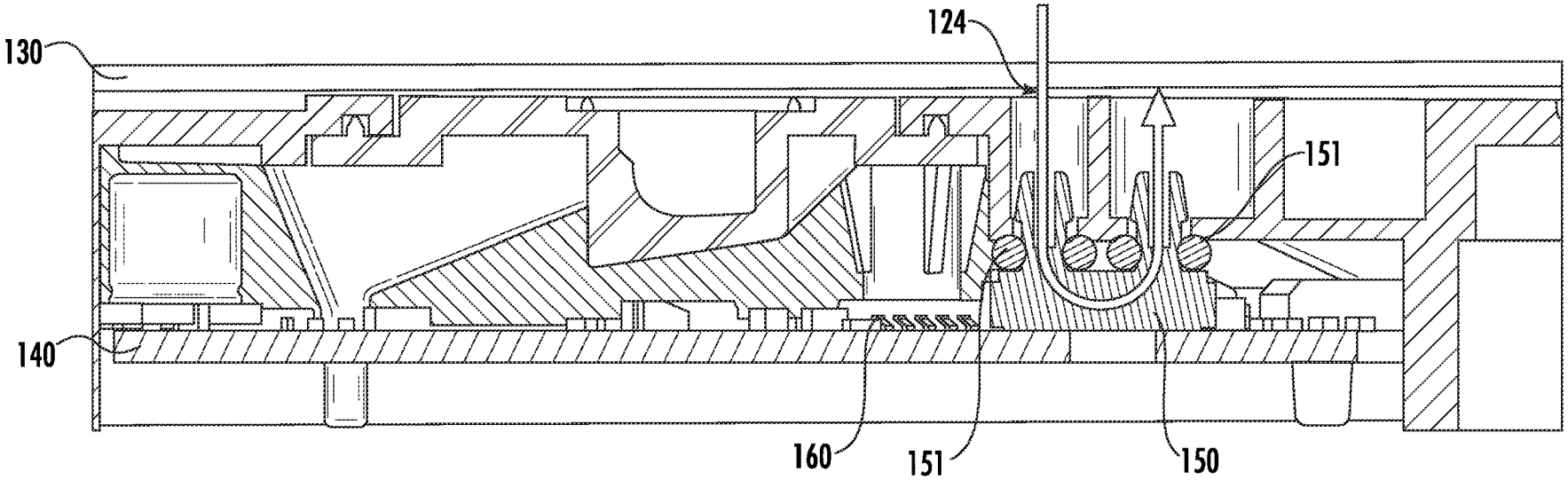
FIG. 10 is a cross-sectional view of a sensor disposed on a supporting structure of the smoke detector shown in FIG. 1 in accordance with one aspect of the disclosure.

In all embodiments the smoke detector 100 may include a controller 160 in communication with the one or more sensor(s) 150 (shown in FIGS. 8-10). It should be appreciated that the controller 160 may also be in communication with the emitter(s) 131, 132 and the receiver 133 (e.g., for the processing of output signals for the smoke detection functionality of the smoke detector 100). It is envisioned that the controller 160 may be a processor (e.g., a microprocessor), capable of receiving and processing output signals (e.g., from the emitter(s) 131, 132, the receiver 133, and/or the sensor(s) 150). For example, the controller 160 may receive output signals (e.g., the pressure differential and/or mass flow readings) from the sensor 150 and determine whether or not a trouble condition is present and a notification should be triggered. The notification may be in the form of a digital signal (e.g., sent from the controller 160 to a control panel (not shown)). Such triggering of a notification (e.g., the sending of a digital signal to a control panel) by a detector 100 may be known to a person of ordinary skill in the art.

The controller 160 may trigger a notification when the sensor 150 detects at least one of: a mass flow outside of an acceptable mass flow range, a negative pressure differential, and a negative mass flow. This notification may cause a trouble condition or an alarm to occur either on the detector 100 or remotely. It is envisioned that the trouble condition or alarm may include at least one of: an audible signal, a visual indicator (e.g., an illumination of an amber LED), and a digital signal. It should be appreciated that an acceptable mass flow range (as set by a certification agency) may be between 100 CFM and 4000 CFM, or other range set by an agency, which may be the range in which the smoke detector 100 is designed and certified to accurately detect smoke particles. In certain instances, both a negative pressure differential and a negative mass flow may indicate that the airflow 400 is going in the wrong direction (e.g., coming in the smoke detector through outlet port 113 and exiting through the inlet port 112), which may compromise the ability of the smoke detector 100 to accurately detect smoke particles.

As mentioned above, the smoke detector 100 may include a supporting structure 140 (shown in FIGS. 8-10). At least one of the emitter(s) 131, 132, the receiver 133, the sensor 150, and the controller 160 may be disposed on the supporting structure 140. Disposed on the supporting structure 140 may mean that the emitter(s) 131, 132, the receiver 133, the sensor 150, and/or the controller 160 may be integrated within the supporting structure 140 (e.g., as a component of the supporting structure 140). It should be appreciated that the smoke detector 100 may include a separate supporting structure (not shown), where one or more of the emitter(s) 131, 132, the receiver 133, the sensor 150, and/or the controller 160 may be supported. For example, if the supporting structure 140 is a printed circuit board (PCB), the controller 160 may be on a separate PCB (not shown), which may be communicatively connected (e.g., through one or more wired or wireless connection) to the main PCB 140.

Figure 3:
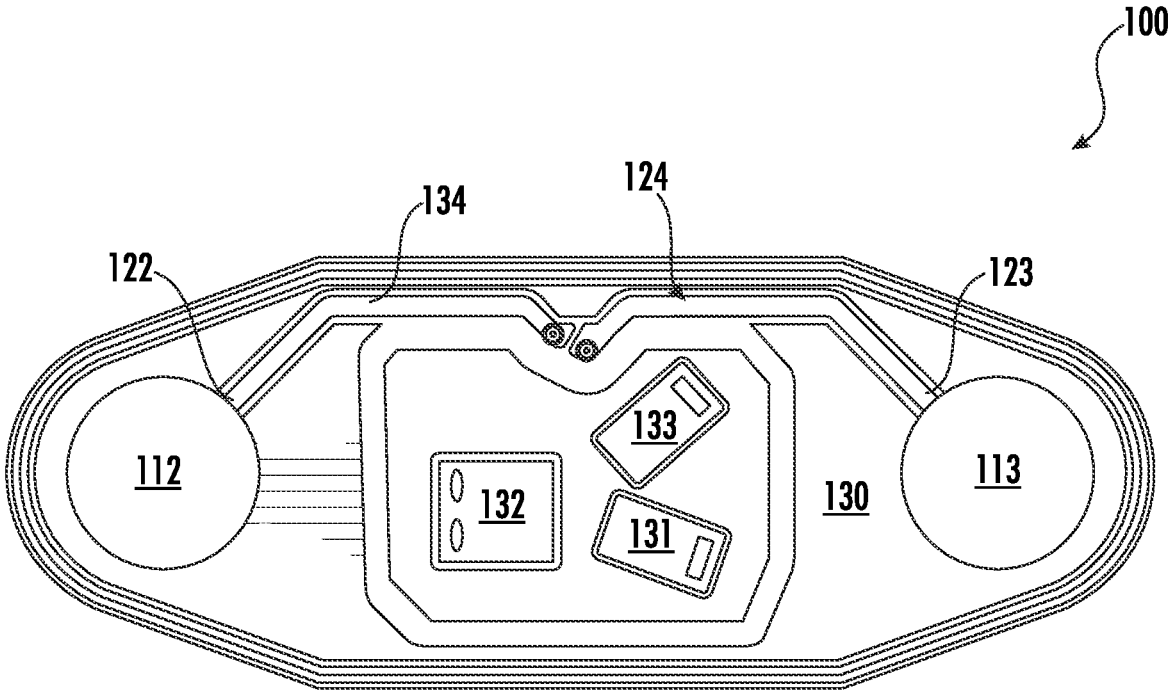
FIG. 3 is a perspective top view of the smoke detector shown in FIG. 1 in accordance with one aspect of the disclosure.
Figure 4:
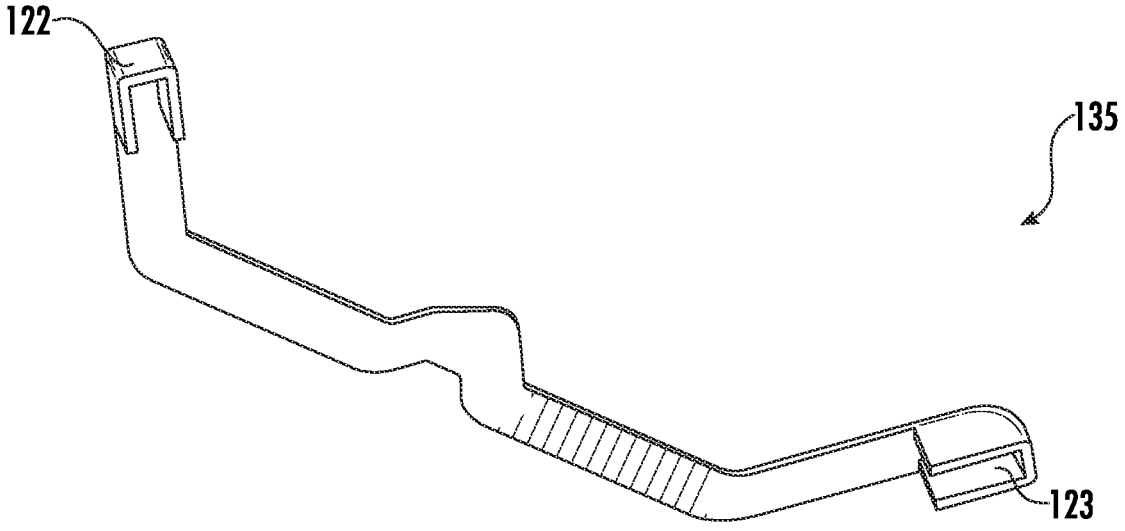
FIG. 4 is a perspective view of a channel cover for the smoke detector shown in FIG. 1 in accordance with one aspect of the disclosure.

As shown in FIGS. 8-10, the supporting structure 140 may be disposed beneath the optics cover 130. For example, the smoke detector 100 may include an optics cover 130 disposed between the housing 110 and the supporting structure 140. It is envisioned that the optics cover 130 may help prevent, or at least mitigate, the airflow 400 (which may contain smoke particles) from contacting the supporting structure 140 (which may contain one or more electrical circuits). It should be appreciated that a portion of the airflow 400 may pass through the sensor 150, which may be supported by the supporting structure 140. However, this portion of the airflow 400 may enter and exit the sensor 140 through the channel 124 configured above or within the optics cover 130, which may prevent the airflow 400 from contacting the supporting structure 140. As shown in FIG. 3 (which depicts a smoke detector 100 with the channel 124 configured within the optics cover 130), the optics cover 130 may include a recessed area 134 configured to receive a channel cover 135 (shown in FIG. 4). The channel 124 may be defined as the space (e.g., void) between upper surface of the recessed area 134 in the optics cover 130 and the interior surface of the channel cover 135. To further ensure that the airflow 400 does not come into contact with the supporting structure 140, the smoke detector 100 may include at least one O-ring 151 (shown in FIGS. 9 and 10) disposed between the optics cover 130 and the sensor 150.

Figure 11:
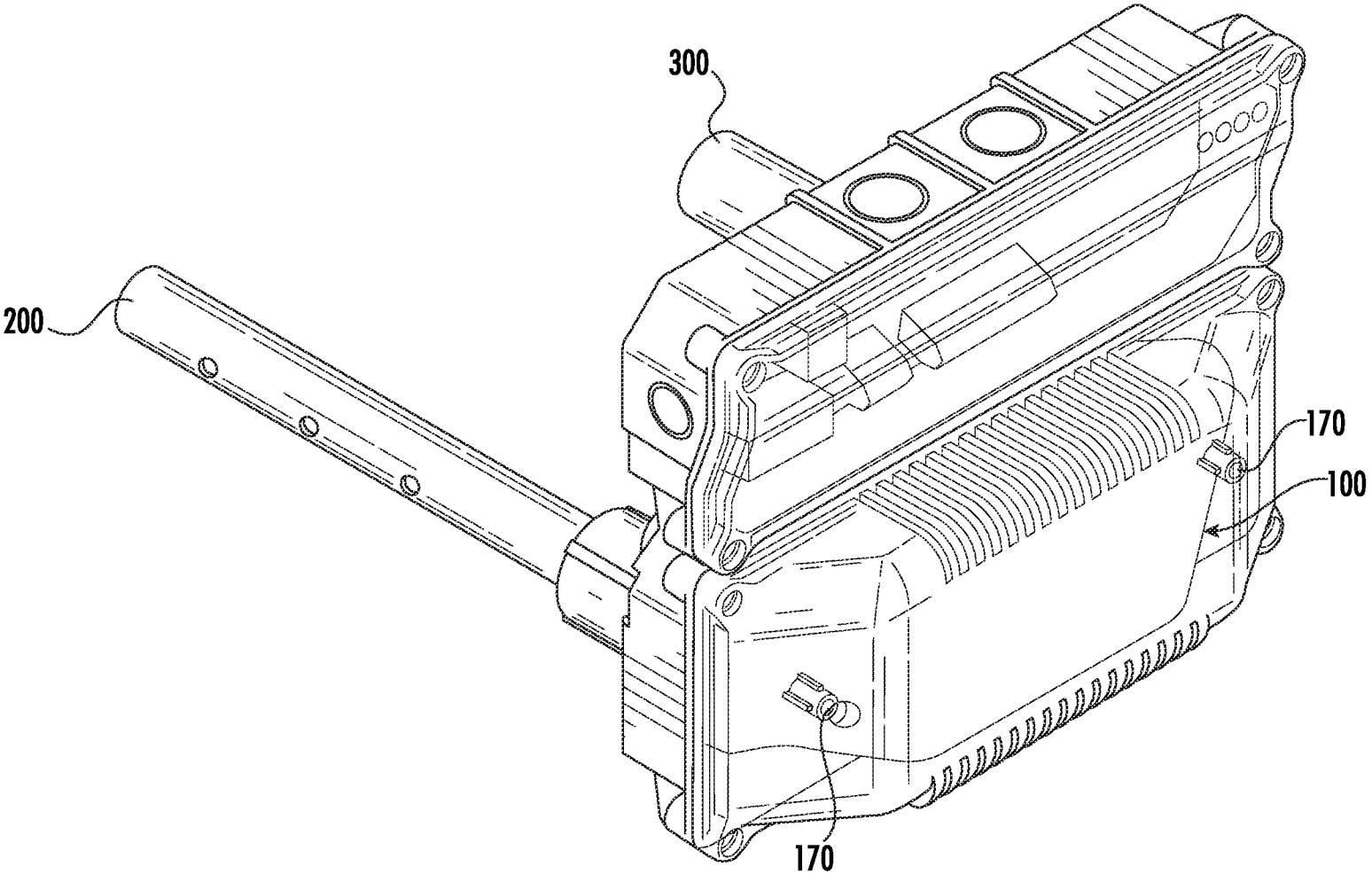
FIG. 11 is a perspective view of an inlet tube connected to the inlet port and an outlet tube connected to the outlet port in accordance with one aspect of the disclosure.
Figure 12:
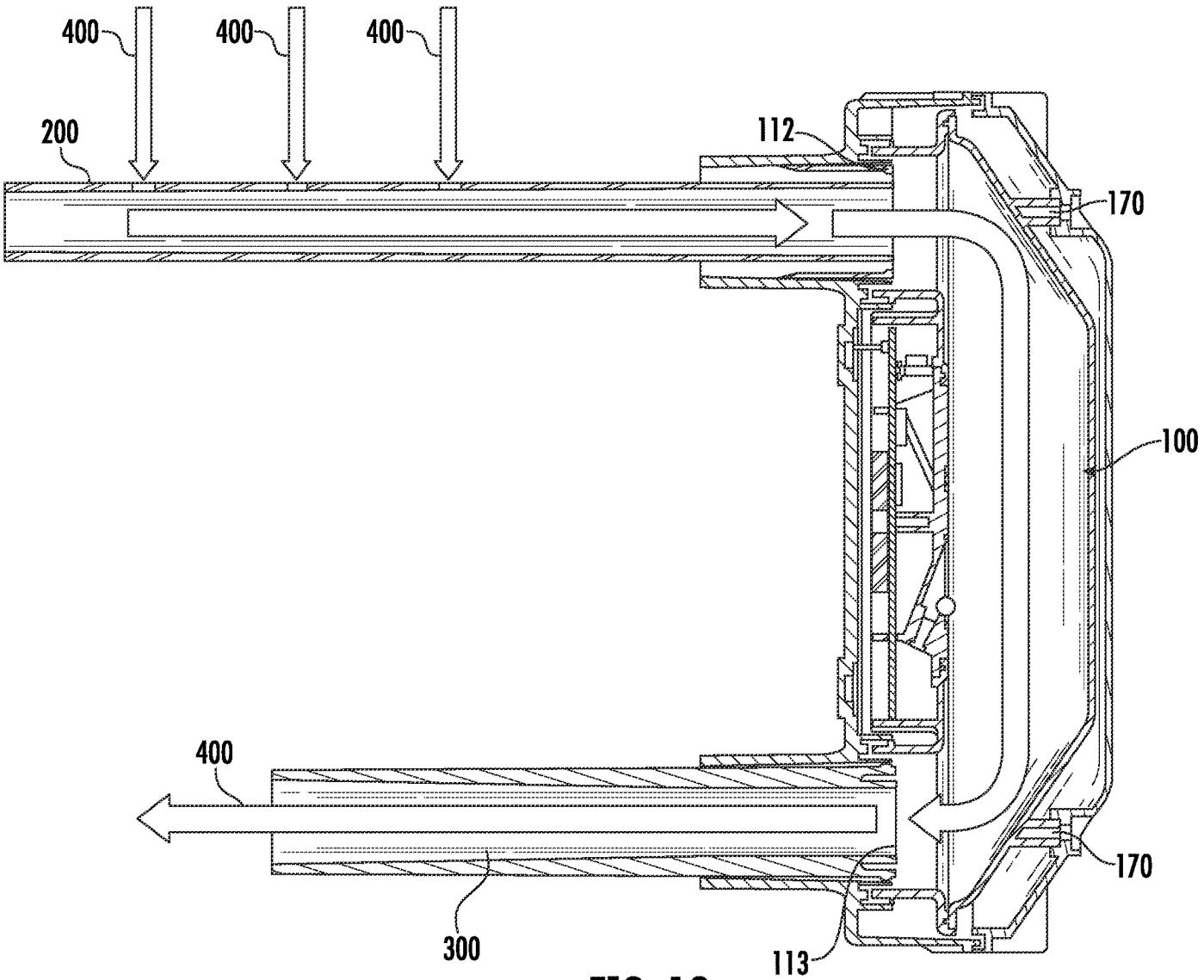
FIG. 12 is a cross-sectional view of an airflow entering through the inlet tube and exiting through the outlet tube in accordance with one aspect of the disclosure.

As mentioned above, the smoke detector 100 described herein may be particularly useful to detect ambient materials in an airflow 400 passing through an HVAC duct (not shown). As shown in FIGS. 11 and 12, the smoke detector 100 may include one or more tube(s) 200, 300 to guide the airflow 400 through the smoke detector 100. It should be appreciated that the smoke detector 100 and/or the tubes 200, 300 may be positioned within the HVAC duct. For example, the smoke detector 100 may be positioned outside the HVAC duct (exposed to the ambient environment) with the tubes 200, 300 positioned inside the HVAC duct (to pull the airflow 400 from inside the HVAC duct through the smoke detector 100). To secure the smoke detector 100 to the HVAC duct, the smoke detector may include one or more attachment point 170. It should be appreciated that the attachment point(s) 170 may be used to secure the smoke detector 100 to another component (which may be directly attached to the HVAC duct), or to secure the smoke detector 100 directly to the HVAC duct.

Figure 13:
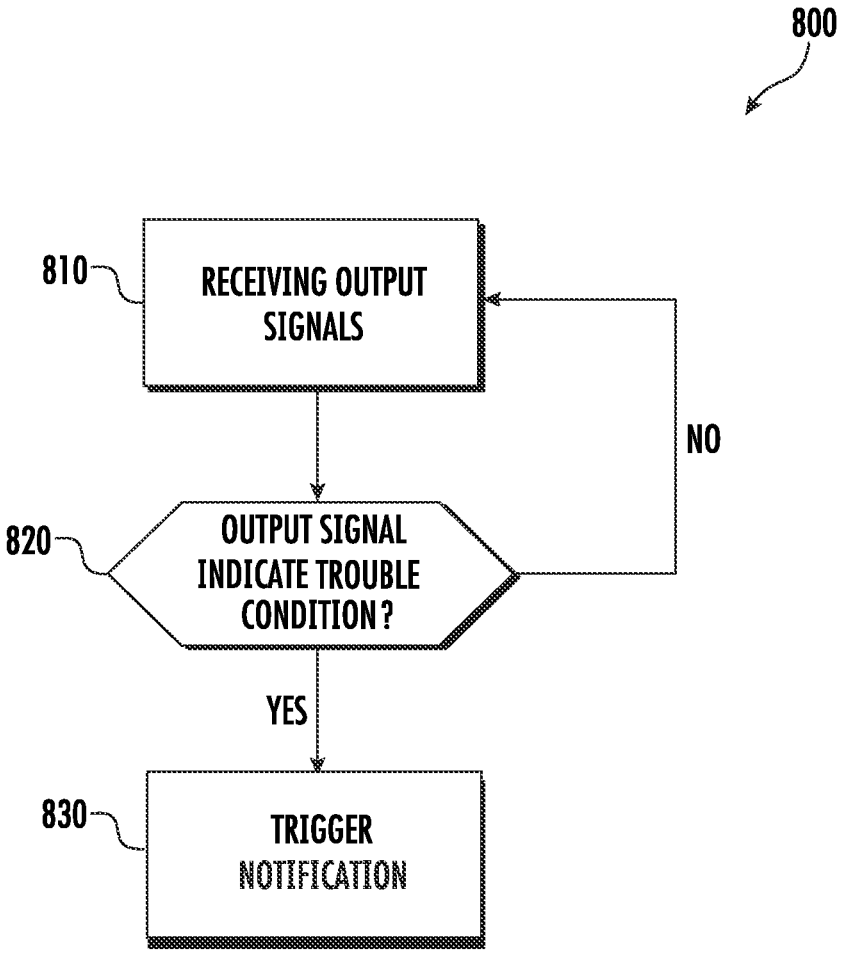
FIG. 13 is a flow diagram illustrating a method for testing a smoke detector in accordance with one aspect of the disclosure.

The configuration/operation of the components in the smoke detector 100 described above make it possible to complete in situ functional testing of the smoke detector 100 (e.g., without having to remove or partially remove the smoke detector 100 from a duct or other installed position to install an external pressure sensor, as is required by traditional duct detectors). For example, by integrating a sensor 150 within the smoke detector 100, the smoke detector 100 can be functionally tested in place without a service technician removing and re-installing an external pressure sensor. An exemplary method 800 for testing the smoke detector 100 is illustrated in FIG. 13. The method 800 may be performed, for example, using the exemplary smoke detector 100 shown in FIGS. 1-12, which includes a controller 160 in communication with a sensor 150 (which is integrated within the smoke detector 100), a housing 110 defining a chamber 111, the housing 110 including an inlet port 112 and an outlet port 113 configured to allow an airflow 400 to pass through the chamber 111. The smoke detector 100 further includes an entry point 122 and an exit point 123, defining a channel 124 therebetween. The channel 124 is in fluid communication with the sensor 150. At least a portion of the airflow 400 passes through the channel 124 (e.g., and therefore through the sensor 150). It should be appreciated that the method 800 may be performed in the controller 160.

As shown in FIG. 13, the method 800 provides step 810 for receiving, from the sensor 150 (which is integrated within the smoke detector 100) at the controller 160, output signals indicating at least one of a pressure differential and a mass flow of the airflow 400. The method 800 provides step 820 for determining, in the controller 160, whether the output signals indicate a need to trigger a notification. In certain instances, the method 800 provides step 830 for triggering a notification when the output signals indicate at least one of: a mass flow outside of an acceptable mass flow range, a negative pressure differential, and a negative mass flow. As mentioned above, the notification may cause a trouble condition or an alarm to occur either on the detector 100 or remotely. It is envisioned that the trouble condition or alarm may include at least one of: an audible alarm signal, a visual indicator (e.g., an illumination of an amber LED), and a digital alarm signal. It should be appreciated that an acceptable mass flow range may be between 100 CFM and 4000 CFM, which may be the range in which the smoke detector 100 is designed and certified to accurately detect smoke particles. In certain instances, both a negative pressure differential and a negative mass flow may indicate that the airflow 400 is going in the wrong direction (e.g., coming in the smoke detector through outlet port 113 and exiting through the inlet port 112), which may compromise the ability of the smoke detector 100 to accurately detect smoke particles. It should be appreciated that this method 800 may be completed without having to install an external sensor, which may make is possible to complete functional testing more routinely (e.g., more than once a year, as recommended).

The use of the terms "a" and "and" and "the" and similar referents, in the context of describing the invention, are to be construed to cover both the singular and the plural, unless otherwise indicated herein or cleared contradicted by context. The use of any and all example, or exemplary language (e.g., "such as", "e.g.", "for example", etc.) provided herein is intended merely to better illuminate the invention and does not pose a limitation on the scope of the invention unless otherwise claimed. No language in the specification should be construed as indicating any non-claimed elements as essential to the practice of the invention.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A smoke detector, comprising:

a housing defining a chamber, the housing comprising an inlet port and an outlet port configured to allow an airflow to pass through the chamber;

an emitter configured to emit light into the chamber;

a receiver configured to receive light reflected by ambient materials in the airflow passing through the chamber; and an entry point disposed in the inlet port and an exit point disposed in the outlet port, defining a channel therebetween, at least a portion of the airflow passing through the channel, the channel in fluid communication with a sensor, the sensor configured to detect at least one of a pressure differential and a mass flow of the airflow passing through the channel.

2. The smoke detector of claim 1, wherein the sensor is disposed in the channel.

3. The smoke detector of claim 1, wherein the channel may be a tubing connecting the entry point and the exit point.

4. The smoke detector of claim 1, wherein at least one of the entry point and the exit point comprise a manifold configuration.

5. The smoke detector of claim 1, further comprising a controller in communication with the sensor, the controller configured to trigger a notification when the sensor detects at least one of: a mass flow outside of an acceptable mass flow range, a negative pressure differential, and a negative mass flow.

6. The smoke detector of claim 1, further comprising a controller, wherein the controller is configured to trigger a notification responsive to the sensor detecting a mass flow outside a range between 100 CFM and 4000 CFM.

7. The smoke detector of claim 5, further comprising a supporting structure, at least one of the emitter, the receiver, the sensor, and the controller disposed on the supporting structure.

8. The smoke detector of claim 7, wherein the supporting structure is a printed circuit board (PCB).

9. The smoke detector of claim 7, further comprising an optics cover disposed between the housing and the supporting structure.

10. The smoke detector of claim 9, wherein the optics cover comprises a recessed area the recessed area configured to receive a channel cover, the channel defined between the recessed area and the channel cover.

11. The smoke detector of claim 9, further comprising at least one O-ring disposed between the optics cover and the sensor.

12. The smoke detector of claim 1, further comprising a tube, the tube configured to be received in at least one of the inlet port and the outlet port, the tube configured to guide the airflow through the smoke detector.

13. The smoke detector of claim 1, wherein the smoke detector is configured to detect ambient materials within an HVAC duct.

14. The smoke detector of claim 13, wherein the housing comprises at least one attachment point for securing the smoke detector to the HVAC duct.

15. The smoke detector of claim 13, wherein the smoke detector detects ambient materials within the HVAC duct using at least one of: a multi-wave multi-angle detection method, a backscatter detection method, and a forward scatter detection method.

16. A method for testing a smoke detector comprising a controller in communication with a sensor, the smoke detector comprising a housing defining a chamber, the housing comprising an inlet port and an outlet port configured to allow an airflow to pass through the chamber, the smoke detector further comprising an entry point disposed in the inlet port and an exit point disposed in the outlet port, defining a channel therebetween, at least a portion of the airflow passing through the channel, the channel in fluid communication with the sensor, the method performed in the controller, the method comprising:

receiving, from the sensor at the controller, output signals indicating at least one of a pressure differential and a mass flow of the airflow parsing through the channel; and determining, in the controller, whether the output signals indicate a need to trigger a notification.

17. The method of claim 16, further comprising triggering a notification when the output signals indicate at least one of: a mass flow outside of an acceptable mass flow range, a negative pressure differential, and a negative mass flow.

18. The method of claim 16, comprising triggering a notification when the output signals indicate a mass flow outside a mass flow range between 100 CFM and 4000 CFM.

* * * * *